US008387677B2

(12) United States Patent
Gallego

(10) Patent No.: US 8,387,677 B2
(45) Date of Patent: Mar. 5, 2013

(54) SELF POSITIONING OF THE STEEL BLANK IN THE GRAPHITE MOLD

(75) Inventor: Gilles Gallego, Ibos (FR)

(73) Assignee: Varel Europe S.A.S., Pau (FR)

( * ) Notice: Subject to any disclaimer, the term of this patent is extended or adjusted under 35 U.S.C. 154(b) by 49 days.

(21) Appl. No.: 13/013,365

(22) Filed: Jan. 25, 2011

(65) Prior Publication Data

US 2011/0180230 A1 Jul. 28, 2011

Related U.S. Application Data

(60) Provisional application No. 61/298,000, filed on Jan. 25, 2010.

(51) Int. Cl.
*B22D 19/04* (2006.01)
*B22C 9/00* (2006.01)

(52) U.S. Cl. ..... 164/112; 164/137; 164/332

(58) Field of Classification Search ..... 164/6, 9, 164/112, 137, 332, 333, 334, 339, 349; 249/187.1
See application file for complete search history.

(56) References Cited

U.S. PATENT DOCUMENTS

| | | | | |
|---|---|---|---|---|
| 2,344,066 | A | 3/1944 | Taylor | |
| 2,371,489 | A | 3/1945 | Williams, Jr. | |
| 2,493,178 | A | 1/1950 | Williams, Jr. | |
| 3,173,314 | A | 3/1965 | Blackmer | |
| 3,175,260 | A | 3/1965 | Bridwell et al. | |
| 3,757,878 | A | 9/1973 | Wilder et al. | |
| 4,234,048 | A | 11/1980 | Rowley | |
| 4,398,952 | A | 8/1983 | Drake | |
| 4,423,646 | A | 1/1984 | Bernhardt | |
| 4,460,053 | A | 7/1984 | Jurgens et al. | |
| 4,499,795 | A | 2/1985 | Radtke | |
| 4,667,756 | A | 5/1987 | King et al. | |
| 4,884,477 | A | 12/1989 | Smith et al. | |
| 5,373,907 | A * | 12/1994 | Weaver | 175/426 |
| 5,666,864 | A | 9/1997 | Tibbitts | |
| 5,732,783 | A | 3/1998 | Truax et al. | |
| 5,944,128 | A | 8/1999 | Truax et al. | |
| 6,045,750 | A | 4/2000 | Drake et al. | |
| 6,073,518 | A | 6/2000 | Chow et al. | |
| 7,398,840 | B2 | 7/2008 | Ladi et al. | |

(Continued)

FOREIGN PATENT DOCUMENTS

| | | |
|---|---|---|
| GB | 2307699 | 6/1997 |
| WO | 9813317 | 4/1998 |

(Continued)

OTHER PUBLICATIONS

U.S. Appl. No. 13/104,790, filed May 10, 2011, Reese et al.

*Primary Examiner* — Kevin P Kerns
(74) *Attorney, Agent, or Firm* — King & Spalding LLP

(57) ABSTRACT

A down hole casting assembly and a method for assembling the down hole casting assembly. The down hole casting assembly includes a mold and a blank coupled to the mold. The mold includes an internal surface surrounding a cavity formed therein and one or more junk slot displacements formed along at least a portion of the internal surface. The junk slot displacement includes a top edge. The blank includes an upper portion, a lower portion, and a bottom edge extending from at least a portion of the upper portion to at least a portion of the lower portion. At least a portion of the bottom edge is coupleable to at least a portion of the top edge. The portion of the bottom edge that couples to the portion of the top edge is complementary in shape so that the blank is positionable within the cavity in a repeatable manner.

24 Claims, 5 Drawing Sheets

U.S. PATENT DOCUMENTS

| | | | | |
|---|---|---|---|---|
| 8,251,122 | B2 * | 8/2012 | Gallego et al. | 164/9 |
| 2002/0096306 | A1 | 7/2002 | Butcher et al. | |
| 2008/0028891 | A1 | 2/2008 | Calnan et al. | |
| 2008/0156148 | A1 | 7/2008 | Smith et al. | |
| 2011/0084420 | A1 | 4/2011 | Reese et al. | |
| 2011/0115118 | A1 | 5/2011 | Gallego et al. | |
| 2011/0121475 | A1 | 5/2011 | Reese et al. | |

FOREIGN PATENT DOCUMENTS

| | | |
|---|---|---|
| WO | 2008091793 | 7/2008 |

* cited by examiner

SELF POSITIONING OF THE STEEL BLANK IN THE GRAPHITE MOLD

RELATED APPLICATIONS

This application claims the benefit of U.S. Provisional Patent Application No. 61/298,000 entitled "Self Positioning Of The Steel Blank In The Graphite Mold," filed Jan. 25, 2010, the entirety of which is incorporated by reference herein.

The present application is related to U.S. patent application Ser. No. 12/578,111, now U.S. Pat. No. 8,061,408 which issued on Nov. 22, 2011, entitled "Casting Method For Matrix Drill Bits And Reamers" and filed on Oct. 13, 2009 and U.S. patent application Ser. No. 12/947,090, entitled "Compensation Grooves to Absorb Dilatation During Infiltration of a Matrix Drill Bit" and filed on Nov. 16, 2010, which are hereby incorporated by reference herein.

BACKGROUND

This invention relates generally to down hole tools and methods for manufacturing such items. More particularly, this invention relates to infiltrated matrix drilling products including, but not limited to, matrix drill bits, bi-center bits, core heads, and matrix bodied reamers and stabilizers, and the methods of manufacturing such items.

Full hole tungsten carbide matrix drill bits for oilfield applications have been manufactured and used in drilling since at least as early as the 1940's. FIG. 1 shows a cross-sectional view of a down hole tool casting assembly 100 in accordance with the prior art. The down hole tool casting assembly 100 consists of a mold 110, a stalk 120, one or more nozzle displacements 122, a blank 124, a funnel 140, and a binder pot 150. The down hole tool casting assembly 100 is used to fabricate a casting (not shown) of a down hole tool.

According to a typical casting method as shown in FIG. 1, the mold 110 is fabricated with a precisely machined interior surface 112, and forms a mold volume 114 located within the interior of the mold 110. The interior surface 112 at least partially surrounds the mold volume 114. The mold 110 is made from sand, hard carbon graphite, or ceramic. The precisely machined interior surface 112 has a shape that is a negative of what will become the facial features of the eventual bit face. The precisely machined interior surface 112 is milled and dressed to form the proper contours of the finished bit. Various types of cutters (not shown), known to persons having ordinary skill in the art, can be placed along the locations of the cutting edges of the bit and can also be optionally placed along the gauge area of the bit. These cutters can be placed during the bit fabrication process or after the bit has been fabricated via brazing or other methods known to people having ordinary skill in the art.

Once the mold 110 is fabricated, displacements are placed at least partially within the mold volume 114 of the mold 110. The displacements are typically fabricated from clay, sand, graphite, or ceramic. These displacements consist of the center stalk 120 and the at least one nozzle displacement 122. The center stalk 120 is positioned substantially within the center of the mold 110 and suspended a desired distance from the bottom of the mold's interior surface 112. The nozzle displacements 122 are positioned within the mold 110 and extend from the center stalk 120 to the bottom of the mold's interior surface 112. The center stalk 120 and the nozzle displacements 122 are later removed from the eventual drill bit casting so that drilling fluid can flow though the center of the finished bit during the drill bit's operation.

The blank 124 is a cylindrical steel casting mandrel that is centrally suspended at least partially within the mold 110 and around the center stalk 120. A tooling (not shown), which is known to people having ordinary skill in the art, is used to suspend the blank 124 within the mold 110. The blank 124 is hanged on the tooling and the tooling is lowered so that the blank 124 is positioned a predetermined distance down into the mold 110 and aligned appropriately therein as desired. This procedure is performed each time a down hole tool that utilizes a blank is fabricated. This process is very time consuming to ensure that the blank 124 is correctly positioned, both height and orientation, within the mold 110; and is thus, a very expensive process.

Once the displacements 120, 122 and the blank 124 have been properly positioned within the mold 110, tungsten carbide powder 130 is loaded into the mold 110 so that it fills a portion of the mold volume 114 that includes an area around the lower portion of the blank 124, between the inner surfaces of the blank 124 and the outer surfaces of the center stalk 120, and between the nozzle displacements 122. Shoulder powder 134 is loaded on top of the tungsten carbide powder 130 in an area located at both the area outside of the blank 124 and the area between the blank 124 and the center stalk 120. The shoulder powder 134 can be made of tungsten powder. This shoulder powder 134 acts to blend the casting to the steel and is machinable. Once the tungsten carbide powder 130 and the shoulder powder 134 are loaded into the mold 110, the mold 110 is typically vibrated to improve the compaction of the tungsten carbide powder 130 and the shoulder powder 134. Although the mold 110 is vibrated after the tungsten carbide powder 130 and the shoulder powder 134 are loaded into the mold 110, the vibration of the mold 110 can be done as an intermediate step before the shoulder powder 134 is loaded on top of the tungsten carbide powder 130. Additionally, the vibration of the mold 110 can be done as an intermediate step before the shoulder powder 134 is loaded on top of the tungsten carbide powder 130 and after the shoulder powder 134 is loaded on top of the tungsten carbide powder 130.

The funnel 140 is a graphite cylinder that forms a funnel volume 144 therein. The funnel 140 is coupled to the top portion of the mold 110. A recess 142 is formed at the interior edge of the bottom portion of the funnel 140, which facilitates the funnel 140 coupling to the upper portion of the mold 110. Although one example has been provided for coupling the funnel 140 to the mold 110, other methods known to people having ordinary skill in the art can be used. Typically, the inside diameter of the mold 110 is similar to the inside diameter of the funnel 140 once the funnel 140 and the mold 110 are coupled together.

The binder pot 150 is a cylinder having a base 156 with an opening 158 located at the base 156, which extends through the base 156. The binder pot 150 also forms a binder pot volume 154 therein for holding a binder material 160. The binder pot 150 is coupled to the top portion of the funnel 140 via a recess 152 that is formed at the exterior edge of the bottom portion of the binder pot 150. This recess 152 facilitates the binder pot 150 coupling to the upper portion of the funnel 140. Although one example has been provided for coupling the binder pot 150 to the funnel 140, other methods known to people having ordinary skill in the art can be used. Once the down hole tool casting assembly 100 has been assembled, a predetermined amount of binder material 160, which is ascertainable by people having ordinary skill in the art, is loaded into the binder pot volume 154. The typical binder material 160 is a copper alloy.

The down hole tool casting assembly 100 is placed within a furnace (not shown). The binder material 160 melts and flows into the tungsten carbide powder 130 through the opening 158 of the binder pot 150. In the furnace, the molten binder material 160 infiltrates the tungsten carbide powder 130. During this process, a substantial amount of binder material 160 is used so that it also fills at least a substantial portion of the funnel volume 144 located above the shoulder powder 134. This excess binder material 160 in the funnel volume 144 supplies a downward force on the tungsten carbide powder 130 and the shoulder powder 134. Once the binder material 160 completely infiltrates the tungsten carbide powder 130, the down hole tool casting assembly 100 is pulled from the furnace and is controllably cooled. The mold 110 is broken away from the casting. The casting then undergoes finishing steps which are known to people having ordinary skill in the art, including the addition of a threaded connection (not shown) coupled to the top portion of the blank 124 and the removal of the binder material 160 that filled at least a substantial portion of the funnel volume 144.

In view of the foregoing discussion, need is apparent in the art for improving the casting process so that the costs associated with casting fabrication are decreased. Additionally, a need is apparent for improving the casting process so that the costs associated with positioning the blank, both the height and the orientation, within the mold is decreased. Further, a need is apparent for improving the casting process so that the positioning of the blank, both the height and the orientation, within the mold is less time consuming. Furthermore, a need is apparent for improving the casting process so that the positioning of the blank, both the height and the orientation, within the mold is more consistent. A technology addressing one or more such needs, or some other related shortcoming in the field, would benefit down hole drilling, for example fabricating castings more effectively and more profitably. This technology is included within the current invention.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

This invention relates generally to down hole tools and methods for manufacturing such items. More particularly, this invention relates to infiltrated matrix drilling products including, but not limited to, matrix drill bits, bi-center bits, core heads, and matrix bodied reamers and stabilizers, and the methods of manufacturing such items. Although the description provided below is related to a drill bit casting, the invention relates to any infiltrated matrix drilling product.

Figure 1:
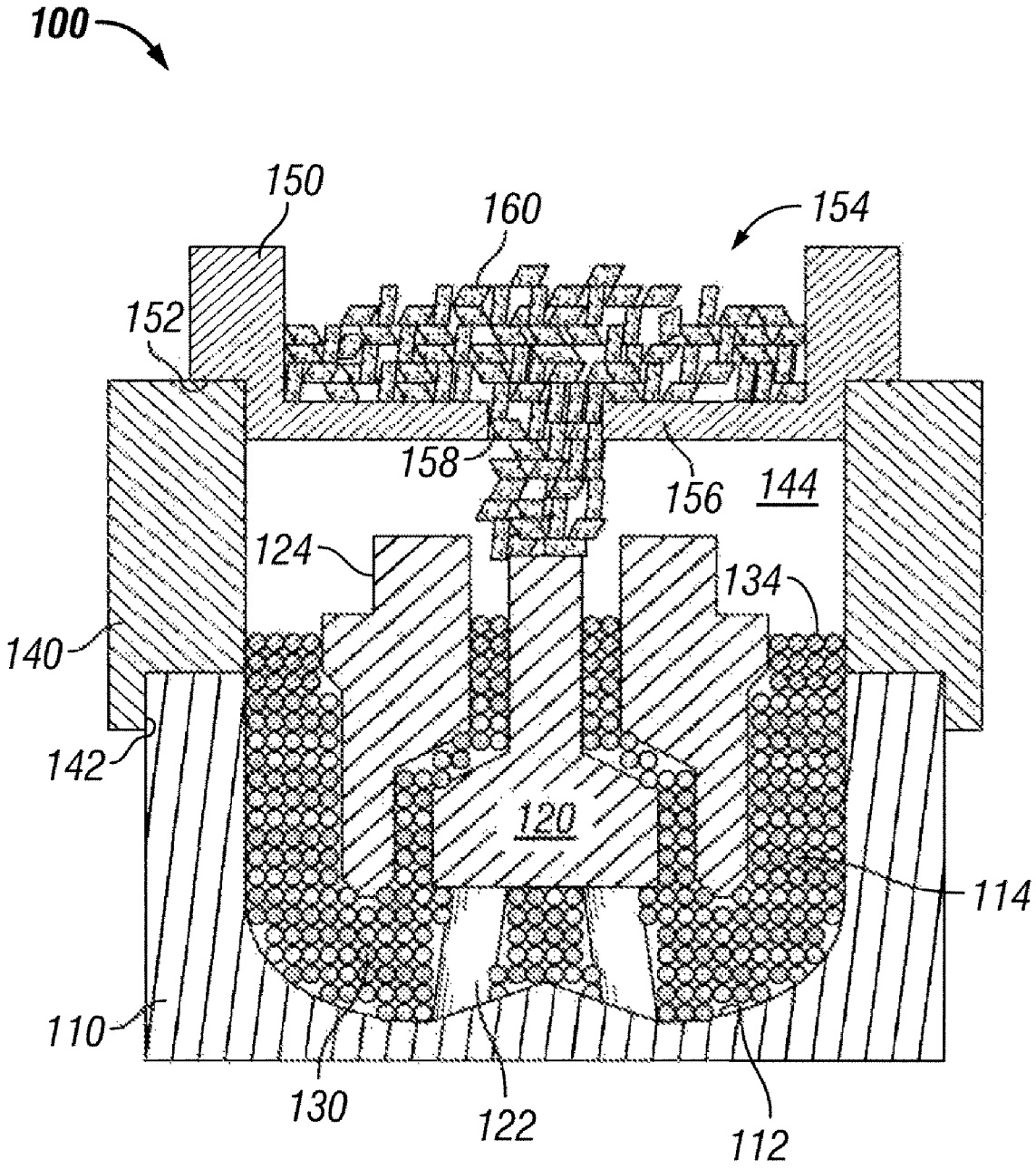
FIG. 1 (Prior Art)
FIG. 1 shows a cross-sectional view of a down hole tool casting assembly in accordance with the prior art.
Figure 2:
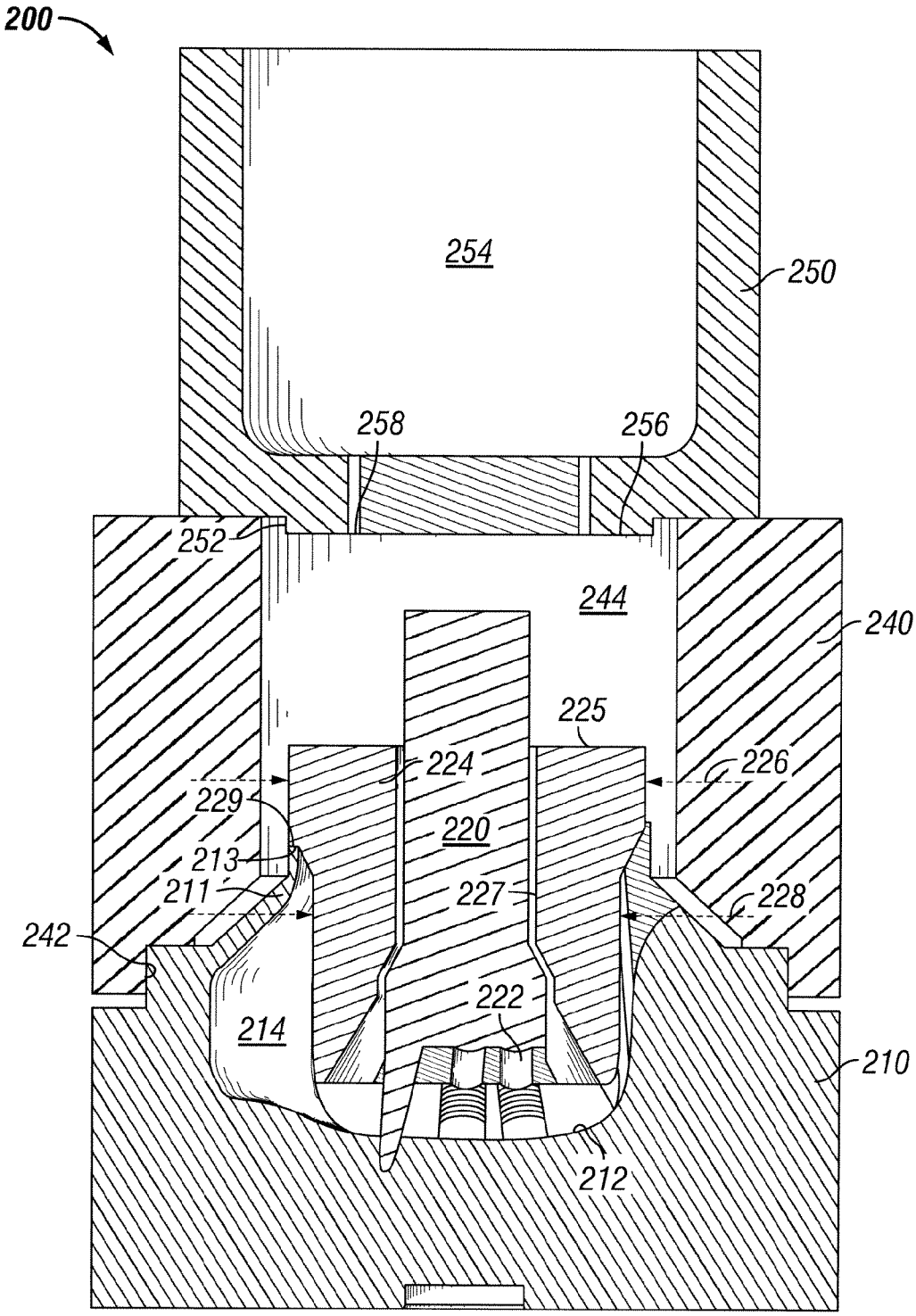
FIG. 2 shows a cross-sectional view of a down hole tool casting assembly in accordance with an exemplary embodiment.

FIG. 2 shows a cross-sectional view of a down hole tool casting assembly 200 in accordance with an exemplary embodiment. The down hole tool casting assembly 200 includes a mold 210, a stalk 220, one or more nozzle displacements 222, a blank 224, a funnel 240, and a binder pot 250. The down hole tool casting assembly 200 is used to fabricate a casting (not shown) of a down hole tool which is a drill bit according to the exemplary embodiment shown.

The mold 210 is fabricated with a precisely machined interior surface 212, and forms a mold volume 214 located within the interior of the mold 210. The interior surface 212 surrounds at least a portion of the mold volume 214. The mold 210 is fabricated from sand, hard carbon graphite, ceramic, or any other material or combination of materials known to people having ordinary skill in the art. The precisely machined interior surface 212 has a shape that is a negative of what will become the facial features of the eventual bit face. The precisely machined interior surface 212 is milled and dressed to form the proper contours of the finished bit. For example, one or more junk slot displacements 211 are formed as part of the mold 210 and also forms a portion of the interior surface 212. Various types of cutters (not shown), known to people having ordinary skill in the art, are placed along the locations of the cutting edges of the bit and also are optionally placed along the gage area of the bit. These cutters can be placed during the bit fabrication process or after the bit has been fabricated via brazing or other methods known to people having ordinary skill in the art.

Once the mold 210 is fabricated, displacements are placed at least partially within the mold volume 214 of the mold 210. The displacements are fabricated from clay, sand, graphite, ceramic, or any other material or combination of materials known to people having ordinary skill in the art. These displacements include the center stalk 220 and at least one nozzle displacement 222. The center stalk 220 is positioned substantially within the radial center of the mold 210 and suspended a desired distance from the bottom of the mold's interior surface 212. The nozzle displacements 222 are positioned within the mold 210 and extend from the center stalk 220 to the bottom of the mold's interior surface 212. Although three nozzle displacements are shown in the cross-sectional view of the exemplary embodiment, greater or fewer nozzle displacements can be positioned without departing from the scope and spirit of the exemplary embodiment. The center stalk 220 and the nozzle displacements 222 are later removed from the eventual drill bit casting, according to methods known to people having ordinary skill in the art, so that drilling fluid can flow though the center of the finished bit during the drill bit's operation.

The blank 224 is a cylindrical steel casting mandrel that is centrally positioned at least partially within the mold 210 and around the center stalk 220. Although some exemplary embodiments include a blank 224 that is cylindrically shaped, the blank can be any geometric or non-geometric shape without departing from the scope and spirit of the exemplary embodiment. Also, although the blank 224 is described as being fabricated from steel, the blank 224 is fabricated using other suitable materials known to people having ordinary skill in the art according to other exemplary embodiments. The blank 224 includes a top portion 225 having a top portion diameter 226 and a bottom portion 227 having a bottom portion diameter 228, which is smaller than the top portion diameter 227, according to certain exemplary embodiments. The top portion 225 includes a bottom edge 229 which couples to a top edge 213 of the junk slot displacements, which is further described below.

Once the displacements 220 and 222 and the blank 224 have been properly positioned within the mold 210, tungsten carbide powder (not shown) is loaded into the mold 210 so that it fills a portion of the mold volume 214 that is around the lower portion of the blank 224, between the inner surfaces of the blank 224 and the outer surfaces of the center stalk 220, and between the nozzle displacements 222. Shoulder powder (not shown) is loaded on top of the tungsten carbide powder in an area located at both the area outside of the blank 224 and the area between the blank 224 and the center stalk 220. The shoulder powder is made of tungsten powder or any other material known to people having ordinary skill in the art. This shoulder powder acts to blend the casting to the blank 224 and is machinable. Once the tungsten carbide powder and the shoulder powder are loaded into the mold 210, the mold 210 is vibrated to improve the compaction of the tungsten carbide powder and the shoulder powder. Although the mold 210 is vibrated after the tungsten carbide powder and the shoulder powder are loaded into the mold 210, the vibration of the mold 210 can be done as an intermediate step before the shoulder powder is loaded on top of the tungsten carbide powder. Alternatively, the vibration of the mold 210 can be done as an intermediate step before the shoulder powder is loaded on top of the tungsten carbide powder and also after the shoulder powder is loaded on top of the tungsten carbide powder.

The funnel 240 is a graphite cylinder that forms a funnel volume 244 therein. The funnel volume 244 is communicably coupled to the mold volume 214. Although some exemplary embodiments include a funnel 240 that is cylindrically shaped, the funnel 240 can be any geometric or non-geometric shape without departing from the scope and spirit of the exemplary embodiment. The funnel 240 is coupled to the top portion of the mold 210. A recess 242 is formed at the interior lower edge of the funnel 240, which facilitates the funnel 240 coupling to the upper portion of the mold 210. Although one exemplary method is provided for the funnel 240 being coupled to the mold 210, other methods known to people having ordinary skill in the art can be used without departing from the scope and spirit of the exemplary embodiments. According to one exemplary embodiment, the inside diameter of the mold 210 is similar to the inside diameter of the funnel 240 once the funnel 240 and the mold 210 are coupled together; however, these diameters can be different without departing from the scope and spirit of the exemplary embodiment. Although the funnel 240 and the mold 210 are described as separate components, according to some exemplary embodiments, the funnel 240 and the mold 210 are formed as a single component without departing from the scope and spirit of the exemplary embodiment.

The binder pot 250 is a cylinder having a base 256 with one or more openings 258 located at the base 256, which extends through the base 256. Although some exemplary embodiments include a binder pot that is cylindrically shaped, the binder pot 250 can be any geometric or non-geometric shape without departing from the scope and spirit of the exemplary embodiment. The binder pot 250 also forms a binder pot volume 254 therein for holding a binder material (not shown). The binder pot volume 254 is communicably coupled to the funnel volume 244. The binder pot 250 is coupled to the top portion of the funnel 240 via a recess 252 that is formed at the exterior lower edge of the binder pot 250. This recess 252 facilitates the binder pot 250 coupling to the upper portion of the funnel 240. Although one exemplary method is provided for the binder pot 250 being coupled to the funnel 240, other methods known to people having ordinary skill in the art can be used without departing from the scope and spirit of the exemplary embodiments. Once the down hole tool casting assembly 200 has been assembled, a predetermined amount of binder material (not shown), determinable by people having ordinary skill in the art, is loaded into the binder pot volume 254. The binder material is a copper alloy or any other binder material known to people having ordinary skill in the art.

The down hole tool casting assembly 200 is placed within a furnace (not shown). The binder material melts and flows into the tungsten carbide powder through the openings 258 of the binder pot 250. Once the binder material completely infiltrates the tungsten carbide powder, the down hole tool casting assembly 200 is pulled from the furnace and is controllably cooled. The mold 210 is broken away from the casting. The casting then undergoes finishing steps which are known to people having ordinary skill in the art, including the addition of a threaded connection (not shown) coupled to the top portion of the blank 224.

Figure 3:
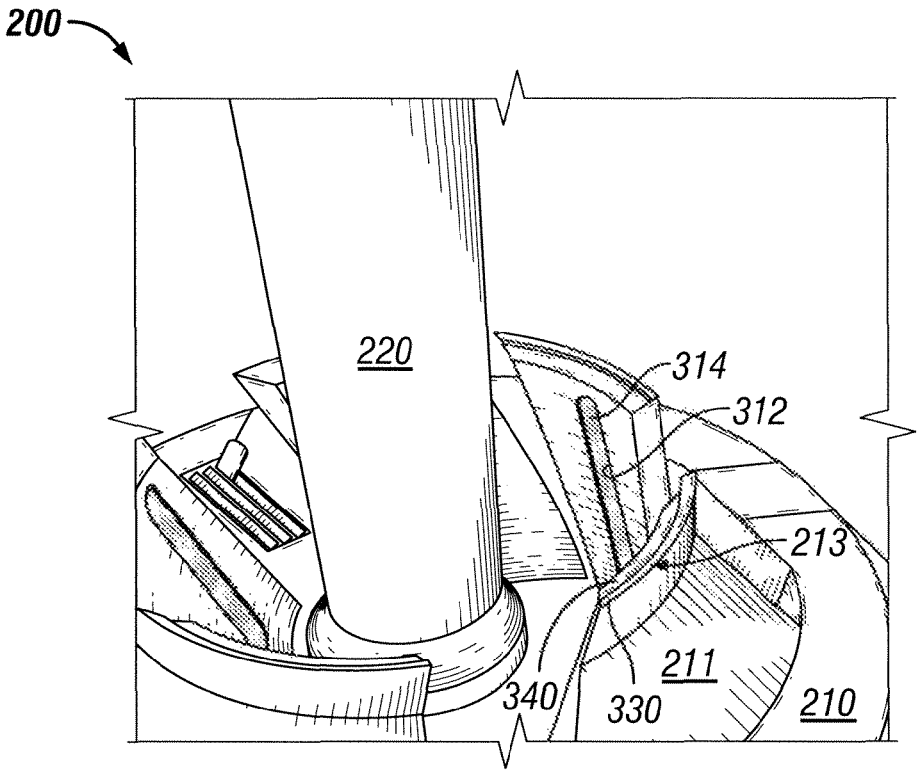
FIG. 3 shows a perspective view of a portion of the down hole tool casting assembly of FIG. 2 which includes a mold and a stalk inserted therein in accordance with an exemplary embodiment.

FIG. 3 shows a perspective view of a portion of the down hole tool casting assembly 200 of FIG. 2 which includes a mold 210 and a stalk 220 inserted therein in accordance with an exemplary embodiment. The mold 210 includes five junk slot displacements 211 formed integrally as part of the mold 210. Although this exemplary embodiment shows the mold 210 having five junk slot displacements 211, the number of junk slot displacements can be greater or fewer without departing from the scope and spirit of the exemplary embodiment. Additionally, although the junk slot displacements 211 are integrally formed with the mold 210, one or more junk slot displacements 211 are formed separately from the mold 210 and thereafter coupled to the mold 210. Each of the junk slot displacements 211 includes the top edge 213.

The top edge 213 includes a top edge cone surface 330 and a top edge planar surface 340 according to some exemplary embodiments. The top edge planar surface 340 extends from the lower edge of the top edge cone surface 330 in a direction towards the stalk 220. The top edge planar surface 340 is oriented substantially horizontally; however, the top edge planar surface 340 can be oriented at an angle without departing from the scope and spirit of the exemplary embodiment. The top edge cone surface 330 extends from the outer edge of the top edge planar surface 340 in a direction away from the stalk 220. The top edge cone surface 330 is oriented at a forty-five degree angle from the horizontal; however, other angles ranging from five degrees to eighty-five degrees can be used without departing from the scope and spirit of the exemplary embodiment. Thus, the top edge 213 is shaped as an obtuse angle according to certain exemplary embodiments. As previously mentioned, the top edge 213 is designed to couple with the blank's bottom edge 229 (FIG. 2). Although one configuration for the top edge 213 has been described, other configurations can be used as long as the other configurations are designed to be coupled with the blank's bottom edge 229 (FIG. 2). For example, the top edge 213 can be designed with one or more peaks and valleys, for example, ridges, so long that the blank's bottom edge 229 (FIG. 2) also has corresponding peaks and valleys that couple with the peaks and valleys of the top edge 213.

The junk slot displacement 211 also includes a generally axially milled groove 312 on the inner surface, which serves to create a pressure relief mechanism to significantly reduce or eliminate cracking problems associated with the casting process. The groove 312 traverses at least a portion of the entire axial length of the milled junk slot displacement 211. For example, the groove 312 traverses a portion of the entire axial length of the milled junk slot displacement 211, wherein the groove 312 does not extend to the top edge of the milled junk slot displacement 211. Alternatively, in accordance with some exemplary embodiments, the groove 312 traverses the entire axial length of the milled junk slot displacement 211. The groove 312 is formed in a variety of patterns which is disclosed in U.S. application Ser. No. 12/947,090, entitled "Compensation Grooves to Absorb Dilatation During Infiltration of a Matrix Drill Bit," the entirety of which is incorporated by reference herein.

In some exemplary embodiments, the groove 312 is filled with a pressure absorbing material 314 to re-establish the desired junk slot displacement 211 shape. The pressure absorbing material 314 assists the groove 312 to absorb the pressure caused by dilatation during the infiltration process. In one exemplary embodiment, the pressure absorbing material 314 is clay; however, other pressure absorbing materials, known to people having ordinary skill in the art and having the benefit of the present disclosure, can be used without departing from the scope and spirit of the exemplary embodiment.

Once the casting is cooled and broken out from the mold 210, a barely perceptible ridge of matrix exists where the matrix was pressed into the pressure absorbing material 314 during infiltration. The ridge is grounded off to leave a uniform surface in the junk slot of the casting in certain exemplary embodiments. Although the groove 312 is shown on the inner diameter of the junk slot displacements 211; in practice, alternative exemplary embodiments include the groove or grooves 312 being deployed along any axial interior surface of the mold 210. Additionally, although some exemplary embodiments have a junk slot displacement 211 that includes a generally axially milled groove 312 on the inner surface, some exemplary embodiments have a junk slot displacement 211 without any generally axially milled groove 312 on the inner surface.

Figure 4A:
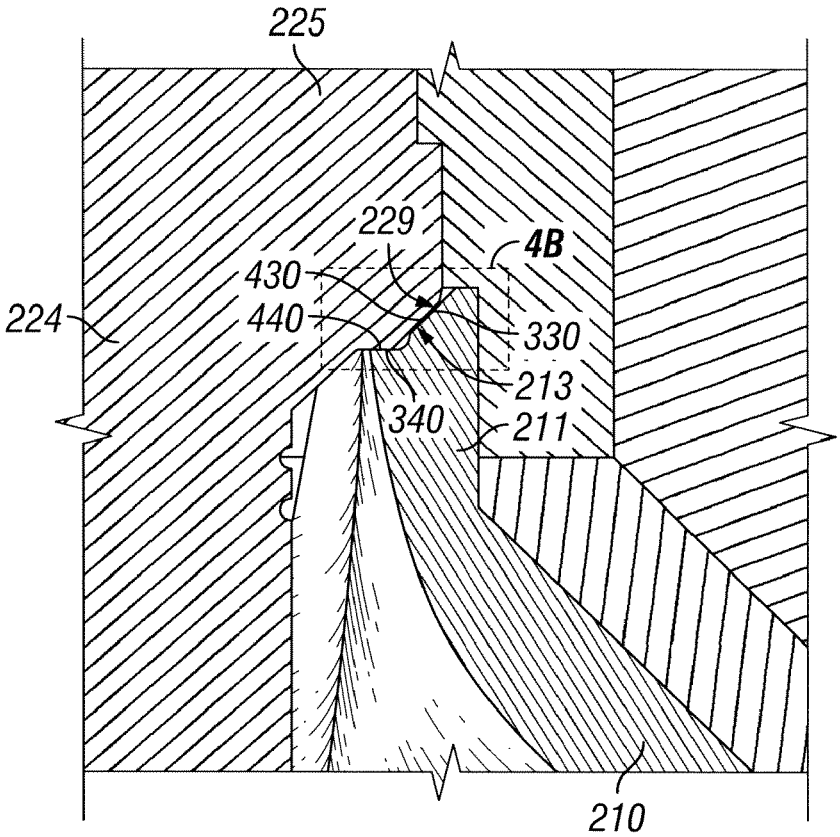
FIGS. 4A and 4B show a cross-sectional view of the interface between a blank and the mold in accordance with an exemplary embodiment.
Figure 4B:
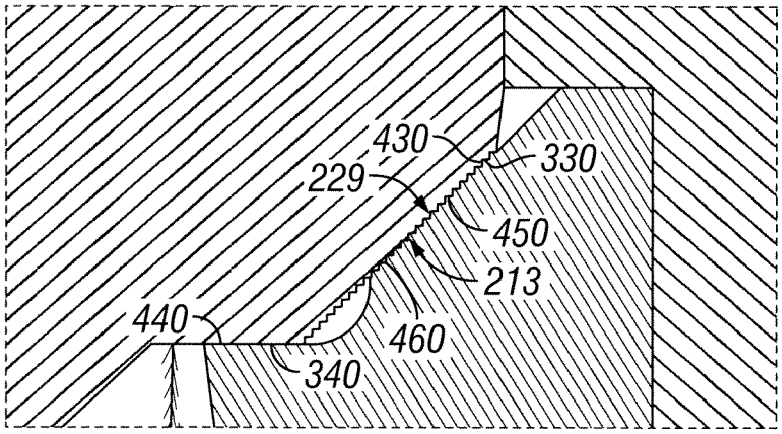

FIGS. 4A and 4B show a cross-sectional view of an interface 460 between the blank 224 and the mold 210 in accordance with an exemplary embodiment. As previously mentioned, the top edge 213 of the junk slot displacement 211 includes the top edge cone surface 330 and the top edge planar surface 340. The top edge planar surface 340 facilitates in positioning the blank 224 to a desired vertical height, while the top edge cone surface 330 facilitates in properly aligning the blank 224 within the mold 210.

Similarly, the bottom edge 229 of the blank's top portion 225 includes a bottom edge cone surface 430 and a bottom edge planar surface 440. The bottom edge planar surface 440 extends from the lower edge of the bottom edge cone surface 430 in a direction towards the interior of the blank 224. The bottom edge planar surface 440 is oriented substantially horizontally; however, the bottom edge planar surface 440 can be oriented at an angle without departing from the scope and spirit of the exemplary embodiment. The bottom edge cone surface 430 extends from the outer portion of the bottom edge planar surface 440 in a direction toward the exterior of the blank 224. The bottom edge cone surface 430 is oriented at a forty-five degree angle from the horizontal; however, other angles ranging from five degrees to eighty-five degrees can be used without departing from the scope and spirit of the exemplary embodiment. As previously mentioned, the bottom edge 229 is designed to couple with the junk slot displacement's top edge 213. Although one configuration for the bottom edge 229 has been described, other configurations can be used as long as the other configurations are designed to be coupled with the junk slot displacement's top edge 213. For example, the bottom edge 229 can be designed with one or more peaks and valleys, for example, ridges, so long that the junk slot displacement's top edge 213 also has corresponding peaks and valleys that couple with the peaks and valleys of the bottom edge 229. The ridges provide resistance to the coupling between the blank 224 and the mold 210 so that the blank 224 does not slip. As shown in FIG. 4B, one or more gaps 450 are formed at the interface 460 created between the top edge 213 and the bottom edge 229. In alternate exemplary embodiments, however, the interface 460 is generally smooth. Although the bottom edge 229 and the top edge 213 each are formed with two surfaces forming an obtuse angle, one or more of the surfaces is formed with fewer or greater surfaces in other exemplary embodiments. For example, the top edge 213 can be formed with one surface and the bottom edge 229 can be formed with a complementary surface such that outer portions of each of the top edge 213 and the bottom edge 229 can be aligned to ensure proper orientation of the blank 224.

Figure 5:
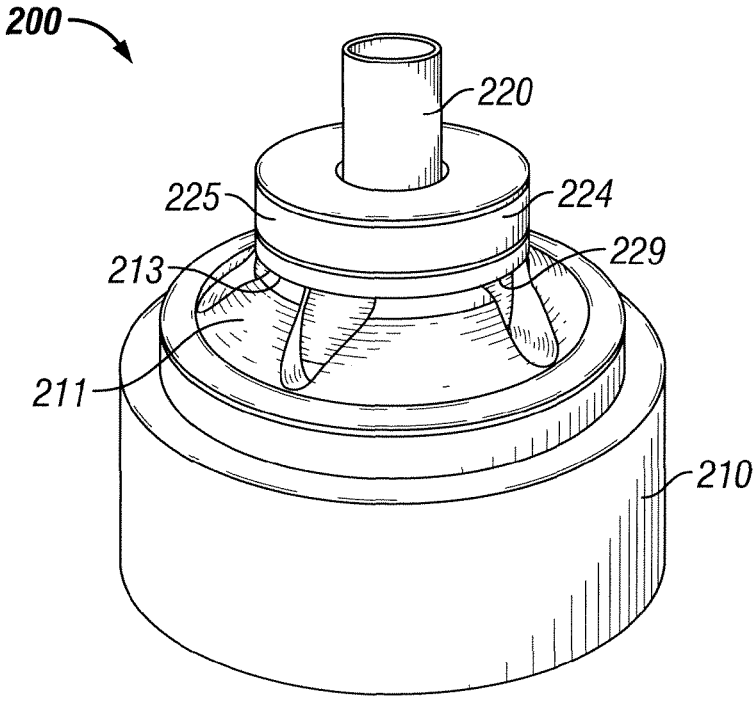
FIG. 5 shows a perspective view of a portion of the down hole tool casting assembly of FIG. 2 which includes a mold, a stalk inserted therein, and a blank coupled to the mold in accordance with an exemplary embodiment.

FIG. 5 shows a perspective view of a portion of the down hole tool casting assembly 200 of FIG. 2 which includes a mold 210, a stalk 220 inserted therein, and a blank 224 coupled to the mold 210 in accordance with an exemplary embodiment. Referring to FIG. 5, the mold 210 includes one or more junk slot displacements 211 having the top edge 213. Additionally, the blank 224 includes the top portion 225 having the bottom edge 229. As seen in FIG. 5, portions of the bottom edge 229 are coupled to the top edges 213 of one or more junk slot displacements 211, which allows for proper orientation of the blank 224 within the mold 210 in a repeatable manner.

Figure 6A:
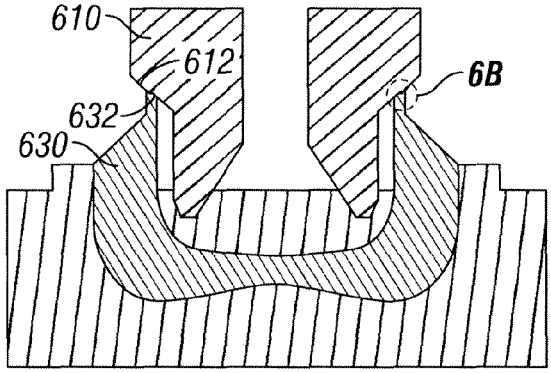
FIG. 6A shows a cross-sectional view of a blank coupled to a mold in accordance with a second exemplary embodiment.
Figure 6B:
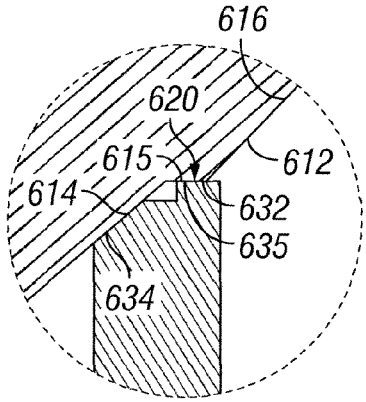
FIG. 6B shows a cross-sectional view of an interface formed between the blank and the mold of FIG. 6A when the blank is coupled to the mold in accordance with a second exemplary embodiment.

FIG. 6A shows a cross-sectional view of a blank 610 coupled to a mold 630 in accordance with a second exemplary embodiment. FIG. 6B shows a cross-sectional view of an interface 620 formed between the blank 610 and the mold 630 of FIG. 6A when the blank 610 is coupled to the mold 630 in accordance with a second exemplary embodiment. Referring to FIGS. 6A and 6B, the blank 610 is similar to the blank 224 (FIG. 2) except that that the shape of the blank's bottom edge 612 is different than the bottom edge 229 (FIG. 2). Similarly, mold 630 is similar to the mold 210 (FIG. 2) except that the shape of the mold's top edge 632 is different than the mold's top edge 213 (FIG. 2). The interface 620 is formed along a portion of the length of the blank's bottom edge 612, and according to certain exemplary embodiments, between the opposing ends of the blank's bottom edge 612. The bottom edge 612 is non-planar and includes at least a first surface 614, a second surface 615, and a third surface 616. The first surface 614 lies in a plane that is substantially parallel to a plane that the third surface 616 lies in; however, in other exemplary embodiments, the first surface 614 lies in a plane that is not parallel to the plane that the third surface 616 lies in. The second surface 615 is coupled at one end to the top portion of the first surface 614 and at another end to the bottom portion of the third surface 616. The top edge 632 is non-planar and includes a first surface 634 and a second surface 635. The second surface 635 is coupled at one end to the first surface 634. The top edge's first surface 634 is oriented similar to the orientation of the bottom edge's first surface 614. Similarly, top edge's second surface 635 is oriented similar to the orientation of the bottom edge's second surface 634. Thus, when the blank 610 is coupled to the mold 630, the blank's first surface 614 is mated with the mold's first surface 634 and the blank's second surface 615 is mated with the mold's second surface 635. This coupling allows for the blank 610 to be properly oriented, horizontally and vertically, within the mold 630. Other features previously discussed, such as ridges, can be included upon one or more surfaces of either or both the top edge 632 and the bottom edge 612.

Figure 7A:
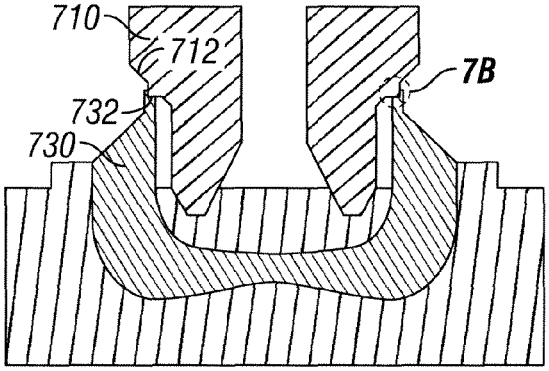
FIG. 7A shows a cross-sectional view of a blank coupled to a mold in accordance with a third exemplary embodiment.
Figure 7B:
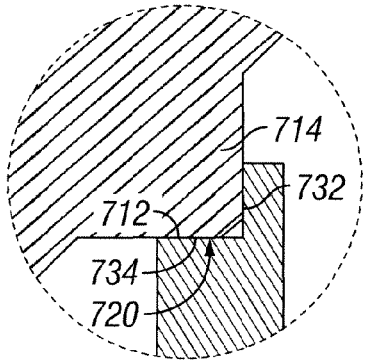
FIG. 7B shows a cross-sectional view of an interface formed between the blank and the mold of FIG. 7A when the blank is coupled to the mold in accordance with a third exemplary embodiment.

FIG. 7A shows a cross-sectional view of a blank 710 coupled to a mold 730 in accordance with a third exemplary embodiment. FIG. 7B shows a cross-sectional view of an interface 720 formed between the blank 710 and the mold 730 of FIG. 7A when the blank 710 is coupled to the mold 730 in accordance with a third exemplary embodiment. Referring to FIGS. 7A and 7B, the blank 710 is similar to the blank 224 (FIG. 2) except that that the shape of the blank's bottom edge 712 is different than the bottom edge 229 (FIG. 2). Similarly, mold 730 is similar to the mold 210 (FIG. 2) except that the shape of the mold's top edge 732 is different than the mold's top edge 213 (FIG. 2). The interface 720 is formed along a portion of the length of the blank's bottom edge 712, and according to certain exemplary embodiments, between the opposing ends of the blank's bottom edge 712. The bottom edge 712 is non-planar and is formed with a protrusion 714 extending outwardly from the remaining surface of the bottom edge 712. The top edge 732 is non-planar and is formed with a complementary indentation 734 extending inwardly from the remaining surface of the top edge 732. The protrusion 714 and the complementary indentation 734 are configured to be mated with one another. Thus, when the blank 710 is coupled to the mold 730, the blank's protrusion 714 is inserted into and mated within the mold's complementary indentation 734. This coupling allows for the blank 710 to be properly oriented, horizontally and vertically, within the mold 730. Other features previously discussed, such as ridges, can be included upon one or more surfaces of either or both the top edge 732 and the bottom edge 712.

Figure 8A:
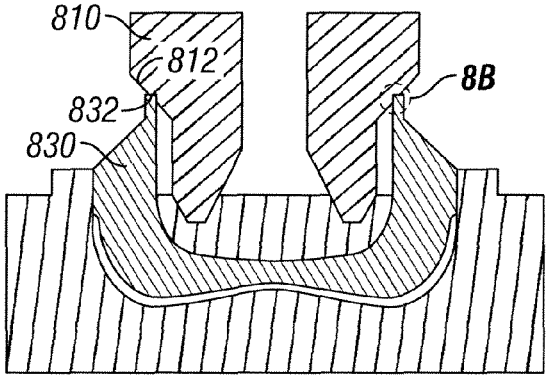
FIG. 8A shows a cross-sectional view of a blank coupled to a mold in accordance with a third exemplary embodiment.
Figure 8B:
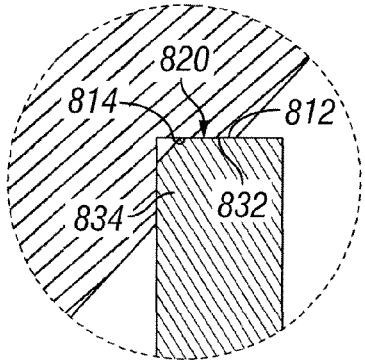
FIG. 8B shows a cross-sectional view of an interface formed between the blank and the mold of FIG. 8A when the blank is coupled to the mold in accordance with a third exemplary embodiment.

FIG. 8A shows a cross-sectional view of a blank 810 coupled to a mold 830 in accordance with a third exemplary embodiment. FIG. 8B shows a cross-sectional view of an interface 820 formed between the blank 810 and the mold 830 of FIG. 8A when the blank 810 is coupled to the mold 830 in accordance with a third exemplary embodiment. Referring to FIGS. 8A and 8B, the blank 810 is similar to the blank 224 (FIG. 2) except that that the shape of the blank's bottom edge 812 is different than the bottom edge 229 (FIG. 2). Similarly, mold 830 is similar to the mold 210 (FIG. 2) except that the shape of the mold's top edge 832 is different than the mold's top edge 213 (FIG. 2). The interface 820 is formed along a portion of the length of the blank's bottom edge 812, and according to certain exemplary embodiments, between the opposing ends of the blank's bottom edge 812. The bottom edge 812 is non-planar and is formed with an indentation 814 extending inwardly from the remaining surface of the bottom edge 812. The top edge 832 is non-planar and is formed with a complementary protrusion 834 extending outwardly from the remaining surface of the top edge 832. The complementary protrusion 834 and the indentation 814 are configured to be mated with one another. Thus, when the blank 810 is coupled to the mold 830, the mold's protrusion 834 is inserted into and mated within the blank's indentation 814. This coupling allows for the blank 810 to be properly oriented, horizontally and vertically, within the mold 830. Other features previously discussed, such as ridges, can be included upon one or more surfaces of either or both the top edge 832 and the bottom edge 812. Although some examples have been provided to properly orient the blank 810 within the mold 830, other examples not explicitly provided for also are included within the scope and spirit of the exemplary embodiments.

Thus, according to exemplary embodiments, the positioning of the height and the alignment of the blank 224, 610, 710, 810 within the mold 210, 630, 730, 830 is improved. Additionally, there is no tooling that is used to perform this positioning and alignment of the blank 224, 610, 710, 810; and hence, tooling adjustments become unnecessary. Further, matrix filling becomes easier since there is no tooling to disrupt the operator. Furthermore, the implementation time for fabricating the casting is shorter since the time consuming process for using a tool to position the blank's height and alignment within the mold 210, 630, 730, 830 is eliminated.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

We claim:

1. A down hole tool casting assembly, comprising:

a mold comprising an internal surface surrounding a cavity formed therein and one or more junk slot displacements, the junk slot displacement forming a portion of the internal surface and comprising a top edge; and a blank comprising a top portion and a bottom portion, the diameter of the top portion being larger than the diameter of the bottom portion, the top portion comprising a bottom edge, wherein at least a portion of the top edge is coupled to at least a portion of the bottom edge to form an interface, the interface facilitating positioning of at least a portion of the blank within the mold.

2. The down hole tool casting assembly of claim 1, wherein the top edge comprises a top edge cone surface and a top edge planar surface extending inwardly from an edge of the top edge cone surface towards an interior of the mold, the top edge cone surface and the top edge planar surface forming an obtuse angle.

3. The down hole tool casting assembly of claim 2, wherein the bottom edge comprises a bottom edge cone surface and a bottom edge planar surface extending inwardly from an edge of the bottom edge cone surface towards an interior of the blank, the bottom edge cone surface and the bottom edge planar surface forming an obtuse angle, the bottom edge being complementary in shape to the top edge.

4. The down hole tool casting assembly of claim 1, wherein at least a portion of at least one of the top edge and the bottom edge comprises ridges.

5. The down hole tool casting assembly of claim 1, wherein at least a portion of at least the top edge and the bottom edge is smooth.

6. The down hole tool casting assembly of claim 1, wherein a portion of the bottom edge comprises a protrusion, a portion of the top edge comprises a complementary indentation, the protrusion being insertable into the complementary indentation thereby facilitating positioning of at least a portion of the blank within the mold.

7. The down hole tool casting assembly of claim 6, wherein at least one of the surfaces of the protrusion and the complementary indentation comprises ridges.

8. The down hole tool casting assembly of claim 1, wherein a portion of the top edge comprises a protrusion, a portion of the bottom edge comprises a complementary indentation, the protrusion being insertable into the complementary indentation thereby facilitating positioning of at least a portion of the blank within the mold.

9. The down hole tool casting assembly of claim 8, wherein at least one of the surfaces of the protrusion and the complementary indentation comprises ridges.

10. The down hole tool casting assembly of claim 1, comprising at least one groove formed along the internal surface of the mold.

11. The down hole tool casting assembly of claim 10, wherein at least one groove is filled with a pressure absorbing material.

12. The down hole tool casting assembly of claim 11, wherein the pressure absorbing material comprises clay.

13. The down hole tool casting assembly of claim 1, wherein one or more junk slot displacements comprise a first end and a second end, the junk slot displacement being generally axially oriented, the junk slot displacement having at least one groove formed in the inner surface of the junk slot displacement, the inner surface of the junk slot displacement facing the cavity.

14. The down hole tool casting assembly of claim 13, wherein at least one groove extends longitudinally from the first end to the second end.

15. The down hole tool casting assembly of claim 13, wherein at least one groove extends a portion of the distance between the first end and the second end.

16. A down hole tool casting assembly, comprising:

a mold comprising an internal surface surrounding a cavity formed therein and one or more junk slot displacements formed radially about the internal surface of the mold, the junk slot displacement forming a portion of the internal surface and comprising a top edge; and a blank comprising a top portion and a bottom portion, the diameter of the top portion being larger than the diameter of the bottom portion, the top portion comprising a bottom edge extending from a portion of the top portion to a portion of the bottom portion, wherein at least a portion of the top edge is coupled to at least a portion of the bottom edge thereby allowing at least a portion of the blank to be positioned within the cavity in a repeatable manner.

17. The down hole tool casting assembly of claim 16, wherein the top edge comprises a top edge cone surface and a top edge planar surface extending inwardly from an edge of the top edge cone surface towards an interior of the mold, the top edge cone surface and the top edge planar surface forming an obtuse angle.

18. The down hole tool casting assembly of claim 17, wherein the bottom edge comprises a bottom edge cone surface and a bottom edge planar surface extending inwardly from an edge of the bottom edge cone surface towards an interior of the blank, the bottom edge cone surface and the bottom edge planar surface forming an obtuse angle, the bottom edge being complementary in shape to the top edge.

19. The down hole tool casting assembly of claim 16, wherein a portion of the bottom edge comprises a protrusion, a portion of the top edge comprises a complementary indentation, the protrusion being insertable into the complementary indentation thereby facilitating positioning of at least a portion of the blank within the mold.

20. The down hole tool casting assembly of claim 16, wherein a portion of the top edge comprises a protrusion, a portion of the bottom edge comprises a complementary indentation, the protrusion being insertable into the complementary indentation thereby facilitating positioning of at least a portion of the blank within the mold.

21. A method for assembling a down hole tool casting assembly, comprising:

providing a mold, the mold comprising an internal surface surrounding a cavity formed therein and one or more junk slot displacements, the junk slot displacement forming a portion of the internal surface and comprising a top edge;

providing a blank, the blank comprising a top portion and a bottom portion, the diameter of the top portion being larger than the diameter of the bottom portion, the top portion comprising a bottom edge extending from at least a portion of the top portion to at least a portion of the bottom portion; and coupling at least a portion of the bottom edge to at least a portion of one or more top edges, wherein at least a portion of the blank is positioned within the cavity in a repeatable manner.

22. The method of claim 21, wherein the top edge comprises a top edge cone surface and a top edge planar surface extending inwardly from an edge of the top edge cone surface towards an interior of the mold, the top edge cone surface and the top edge planar surface forming an obtuse angle, and wherein the bottom edge comprises a bottom edge cone surface and a bottom edge planar surface extending inwardly from an edge of the bottom edge cone surface towards an interior of the blank, the bottom edge cone surface and the bottom edge planar surface forming an obtuse angle, the bottom edge being complementary in shape to the top edge.

23. The method of claim 21, wherein a portion of the bottom edge comprises a protrusion, a portion of the top edge comprises a complementary indentation, the protrusion being insertable into the complementary indentation thereby facilitating positioning of at least a portion of the blank within the mold.

24. The method of claim 21, wherein a portion of the top edge comprises a protrusion, a portion of the bottom edge comprises a complementary indentation, the protrusion being insertable into the complementary indentation thereby facilitating positioning of at least a portion of the blank within the mold.

* * * * *